US007722440B2

(12) United States Patent
Pötzsch et al.

(10) Patent No.: US 7,722,440 B2
(45) Date of Patent: May 25, 2010

(54) METHOD AND DEVICE FOR GRINDING CERAMIC SPHERES

(75) Inventors: Michael Pötzsch, St. Augustin (DE); Walter Karb, Schwebheim (DE); Michael Haubert, Bonn (DE); Karl-Otto Stock, St. Augustin (DE); Marco Weber, Herzogenrath (DE)

(73) Assignee: Atlantic GmbH (DE)

( * ) Notice: Subject to any disclaimer, the term of this patent is extended or adjusted under 35 U.S.C. 154(b) by 0 days.

(21) Appl. No.: 11/814,975

(22) PCT Filed: Jan. 6, 2006

(86) PCT No.: PCT/EP2006/000075

§ 371 (c)(1),
(2), (4) Date: Dec. 3, 2007

(87) PCT Pub. No.: WO2006/079444

PCT Pub. Date: Aug. 3, 2006

(65) Prior Publication Data

US 2008/0171492 A1 Jul. 17, 2008

(30) Foreign Application Priority Data

Jan. 27, 2005 (DE) ..... 10 2005 004 038

(51) Int. Cl.
*B24B 11/06* (2006.01)
*B24B 1/00* (2006.01)

(52) U.S. Cl. ..... 451/49; 451/41; 451/50; 451/259; 451/28

(58) Field of Classification Search ..... 451/49, 451/41, 36, 285–288, 50, 262, 548, 259, 451/28

See application file for complete search history.

(56) References Cited

U.S. PATENT DOCUMENTS

| | | | | |
|---|---|---|---|---|
| 5,533,923 | A * | 7/1996 | Shamouilian et al. | 451/41 |
| 5,584,146 | A * | 12/1996 | Shamouillan et al. | 51/293 |
| 5,633,068 | A * | 5/1997 | Ryoke et al. | 428/143 |
| 6,110,023 | A * | 8/2000 | Shinomoto et al. | 451/262 |
| 6,171,179 | B1 * | 1/2001 | Chiou et al. | 451/262 |
| 6,769,969 | B1 * | 8/2004 | Duescher | 451/59 |
| 2003/0050000 | A1 * | 3/2003 | Nonogawa et al. | 451/544 |
| 2005/0202770 | A1 * | 9/2005 | Chesley et al. | 451/538 |
| 2008/0171492 | A1 * | 7/2008 | Potzsch et al. | 451/41 |

FOREIGN PATENT DOCUMENTS

| | | |
|---|---|---|
| DE | 198 16 252 | 4/1999 |
| JP | 05042487 | 2/2003 |

* cited by examiner

*Primary Examiner*—Lee D Wilson
(74) *Attorney, Agent, or Firm*—Robert W. Becker; Robert W. Becker & Assoc

(57) ABSTRACT

A method and apparatus for grinding spheres of ceramic material, including the spheres with at least one grinding wheel containing abrasive grains bound in a synthetic resin. The abrasive grains comprise more than 50% diamond and less than 5%, $Cr_2O_3$.

21 Claims, 2 Drawing Sheets

METHOD AND DEVICE FOR GRINDING CERAMIC SPHERES

BACKGROUND OF THE INVENTION

The instant application should be granted the priority dates of Oct. 18, 2005, the filing date of the corresponding German patent application 10 2004 030 063 1, as well as Mar. 8, 2005, the filing date of the International patent application PCT/EP2005/002441.

The present invention relates to a method and a device for grinding ceramic spheres.

The term "ceramic spheres" is to be understood in the context of the present patent application as referring to spheres made of ceramic materials such as, for example, oxide ceramics, carbides, silicon nitride, precious and semi-precious stones but also glass.

Currently, the grinding of ceramic spheres for achieving low degrees of surface roughness and high quality classes is generally carried out using devices such as are also used for the machining of metal spheres. The ceramic spheres are in this case not actually ground but rather lapped. Whereas in the machining of metallic spheres there is provided initially coarse grinding and then fine grinding using grinding wheels with bound abrasive grains and lapping is optionally practiced thereafter with abrasive grains present in paste form, ceramic spheres are not machined using grinding wheels but rather lapped over the entire abrasion process. The abrasive grains present in the grinding paste are in this case generally in diamond form.

Technologically, this process s exceptionally difficult to carry out, for the abrasion rate is in the order of magnitude of at most 100 um per day. The abrasion to be realized of from 0.2 to 0.4 in sphere diameter corresponds to the thickness of the inhomogeneous boundary layer and is in some cases achieved only in a machining time of several days. In addition, after the lapping process, the ceramic spheres are markedly soiled by adhering grinding paste. In the conventional methods for washing the spheres, this grinding paste is in some cases very difficult to remove. The degree of wear of the two metal disc is extremely high during tapping with loose diamond grains. Finally, the very high consumption of diamonds greatly increases the costs of the method as a whole. As a result, the use of ceramic spheres has become established, especially in the field of ball bearings, only in applications in which costs are of secondary importance.

An attempt to improve the cost-effectiveness is found in U.S. Pat. No. 6,171,179 B1. In the grinder provided in said document, a grinding wheel is provided with electrolytically bound abrasive grains. The fixed guide disc has a number of guide rings which are each hydraulically loaded individually to ensure optimally uniform pressing of the ceramic spheres against the grinding wheel. This device has not proven successful in practice. It is believed that the service life of the grinding wheel is too short.

Japanese patent application JP 05042467 A discloses a method for the polishing of silicon nitride spheres using polishing discs having abrasive grains of from 5 to 60 percent by volume of $Cr_2Os$ with an average particle diameter of from 0.01 to 3 um. The machining of the spheres is very low with regard to the speed of abrasion of the surface. In a test, abrasion of 60 um was achieved over 50 hours, i.e. approximately 1 um per hour. The degree of surface roughness achieved in a second test is Ra=0.005 um. This method, which also proposes replacing a portion of the $Cr_2O3$ with diamond, is suitable for achieving high surface qualities, although the abrasion rate is still unsatisfactory for the grinding of ceramic spheres.

The object of the present invention is therefore to provide a method and a device for grinding ceramic spheres allowing more economical manufacture of ceramic spheres having the requisite qualify and low divergence in the diameter of the spheres.

SUMMARY OF THE INVENTION

Because pursuant to the present invention the grinding is carried out using a grinding wheel with abrasive grains bound in a synthetic resin, wherein the abrasive grains comprise more than 50% diamond and less than 5% CrjOs, high abrasion rates can be achieved with a low degree of wear of the grinding wheel or the abrasive lining. It is advantageous if the abrasive grains are free from C^Os and, in particular, if the abrasive grains consist of pure diamond. This allows an abrasion rate almost ten times higher than that of the closest prior art, whereas the average degree of surface roughness is greater by a factor of 10than in the prior art. The diamond content of the abrasive grains is therefore greater than 50%, in particular greater than 90% and particularly preferred are abrasive grains consisting of 100% diamond.

Advantageously, the synthetic resin bonding is a hot-pressed phenolic resin bonding or polyimide bonding, the pore volume preferably being close to zero.

The grinding wheel preferably has a grain size of from D181 (in accordance with the FEPA standard, average particle diameter=181 um) to D2 (average particle diameter=2 um), grain sizes of from D181 to D25 being used for coarse grinding and grain sizes of from D15 to D2 being preferred for fine grinding.

During use, grinding wheels undergo slight deformation if they are fastened, in particular attached using putty, to a support plate as an abrasive lining. The degree of wear is further reduced if the cooling lubricant added is a honing oil.

Another embodiment of The invention provides for two grinding wheels to be used in a stone-to-stone process, the two grinding wheels being, in particular, of substantially identical construction.

The above-described method is possible as a result of the fact that provision is made, in a device according to the invention for grinding ceramic spheres using a grinding wheel with bound abrasive diamond grains, for the grinding wheel to have a synthetic resin bonding, in particular a hot-pressed phenolic resin bonding. The grinding wheel can in this case be attached to a support plate using putty, thus promoting the mechanical stability under the process pressure and minimizing the material costs for the manufacture of the wheel.

Also in accordance with the invention is the use of a grinding wheel with abrasive diamond grains bound in a synthetic resin for the grinding of ceramic spheres, especially using a conventional sphere grinder, such as is known for the grinding of metallic spheres.

BRIEF DESCRIPTION OF THE DRAWINGS

The present invention will be described hereinafter with reference to the drawings and also with reference to three examples. In the drawings.

DESCRIPTION OF PREFERRED EMBODIMENTS

Figure 1:
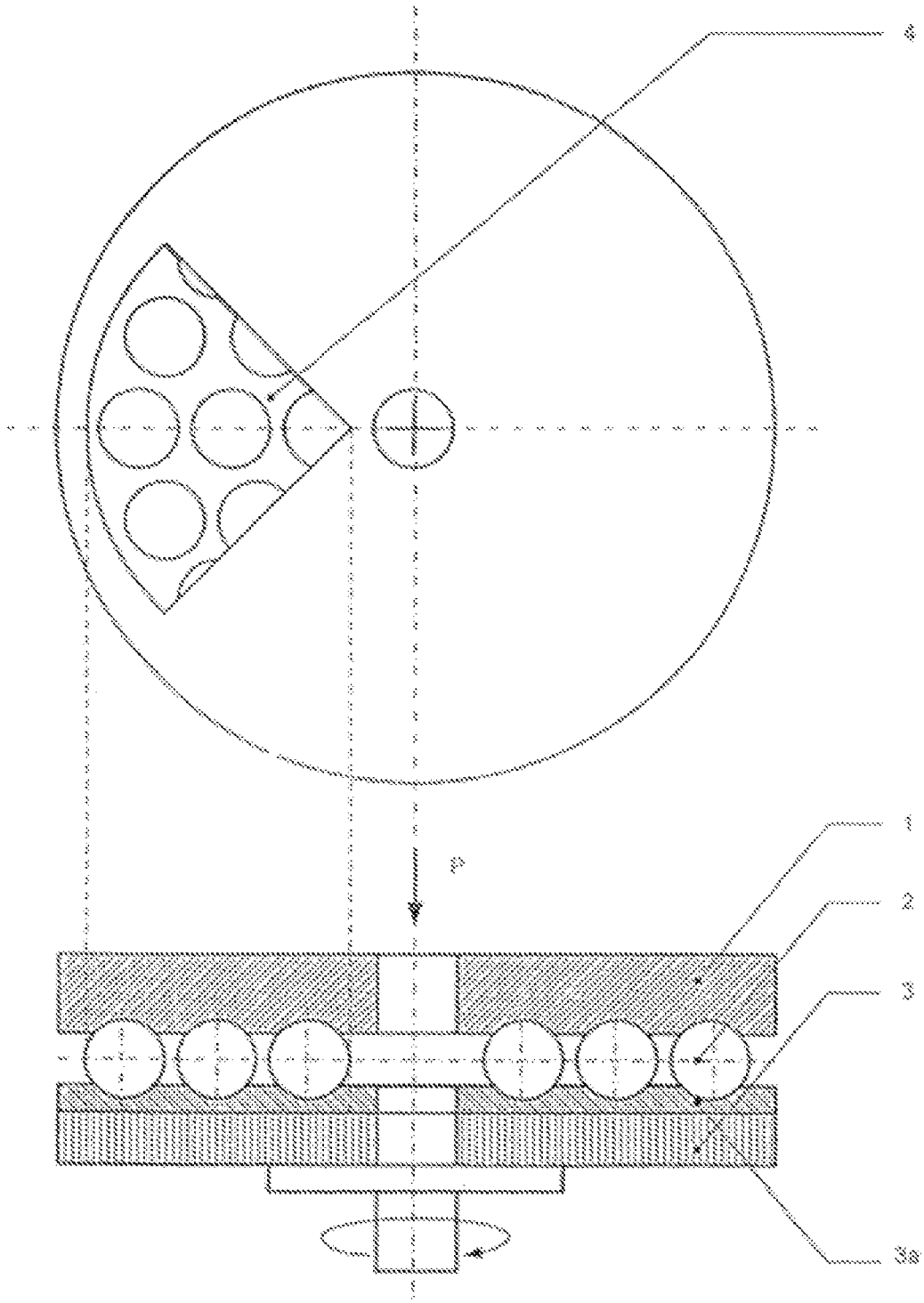
FIG. 1 shows a device for the grinding of spheres with a grinding wheel and a vertical drive axis.

FIG. 1 illustrates the principle of the grinding of spheres on machines with a vertical drive axis. FIG. 1 is a schematic plan view and side view of the device for grinding spheres. A fixed guide disc 1, made preferably of cast steel, is provided in this case. The guide disc 1 has on its underside peripheral guide grooves in which a large number of spheres 2 to be ground are guided. Provided from the underside is a support plate 3 which has an abrasive lining 3*a* arranged thereon and can be caused to rotate by a drive shaft. A sphere inlet and outlet 4 is provided for loading and unloading the device.

Figure 2:
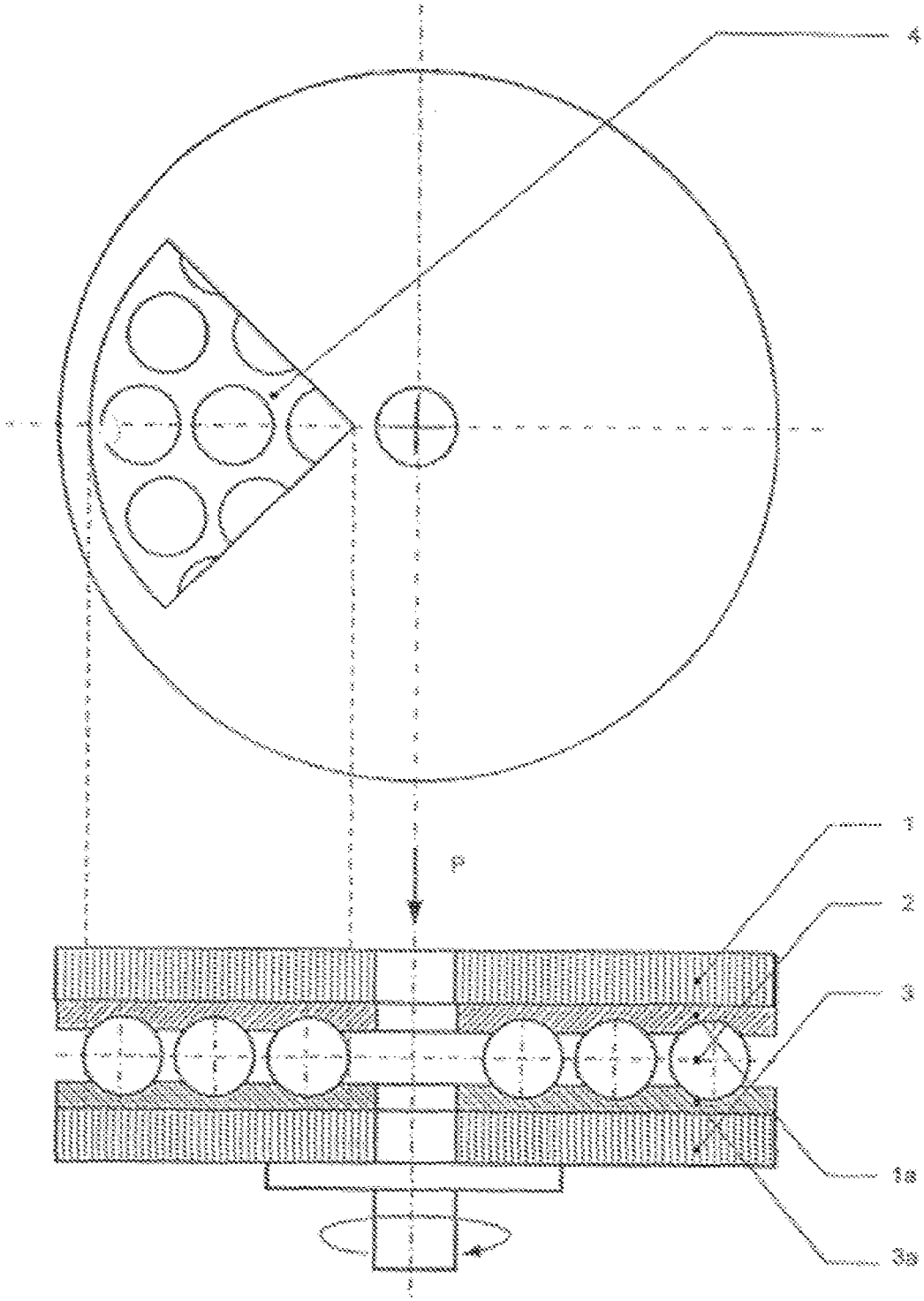
FIG. 2 shows a device for the grinding of spheres in a stone-to-stone process with a vertical axis.

FIG. 2 shows a grinder similar to that illustrated in FIG. 1. In the case of this grinder, the fixed guide plate 1 is also provided with an abrasive lining 1*a* arranged opposing the abrasive lining 3*a* of the rotating support plate 3. The spheres 2 to be ground are arranged between the two grinding wheels 1*a* and 3*a*.

In both embodiments, for the purposes of grinding, a pressure P is exerted on the fixed guide disc 1 from the upper side. The support plate 3 is caused to rotate by a drive, so the spheres 2 roll off in the guide grooves. The differences in speed in the various regions of the guide grooves cause movement of the abrasive lining relative to the surface of the ceramic sphere. The abrasive grains located in the abrasive lining then lead to abrasion of the surface of the sphere and thus to improvement of the surface quality and the spherical shape.

The method according to the invention can be carried out in this case both on a sphere grinder comprising a vertical drive shaft and on a sphere grinder comprising a horizontal drive shaft.

During the grinding process, the cooling lubricant added is a honing oil which both rinses around the abrasive grains and the ceramic sphere and removes abrasive grains, bonding particles and ground-off spheres broken out of the surface of the grinding wheels, so such elements do not adhere to the surface of the sphere and adversely affect the grinding process.

The results achieved using the method according to the invention will be described hereinafter with reference to three test examples.

Tests 1 to 3 used a grinding wheel having a diameter of 200 mm and a thickness of 4 mm. The grinding wheel was attached to a steel support plate using putty. The cooling lubricant added was the honing oil EMOL®-O-HON 920 NV from ML Lubrication GmbH. The pressure plate consisted of steel and had five peripheral grooves. The grinding was carried out without a hopper on a grinder having a vertical axis.

Test 1:

Round spheres made of zirconium oxide ($ZrO_2$) and having starting dimensions of from 5.96 mm to 6.03 mm were machined. A batch contained approximately 140 spheres. The final dimensions achieved were 5.50 mm. The abrasion was 504 um over a grinding time of 4 hours. The abrasion rate was therefore approximately 125 um per hour. The depth of the grooves in the grinding wheel after completion of the test was 0.5 mm.

Test 2:

Barrel-shaped spheres made of ZrOi and having starting dimensions of 5.72 mm×5.25 mm were machined. In total, the batch comprised 300 blanks. The final dimensions were 5.15 mm. The average abrasion was 570 um over a grinding time of 3.75 hours. This corresponds to an average abrasion rate of 152 um per hour. The depth of the grooves in the grinding wheel after completion of the test was 0.94 mm.

Test 3:

Spheres made of silicon nitride (SisN^ having starting dimensions of 5.34 mm were machined. A batch contained 300 blanks. The final dimensions were 5.16 mm. The average abrasion was 180 um over a grinding time of 3.5 hours. The average abrasion rate was 51 um per hour. The depth of the grooves in the grinding wheel after completion of the test was 1.10 mm.

The specified groove depths are based on the same grinding wheel, as the same wheel was used in all three successive tests. Test 2 accordingly started with a groove depth of 0.5 mm, whereas Test 3 started with a groove depth of 0.94 mm. The groove depth therefore increased in size, for example, in Test 3 merely by 0.16 mm.

Test 4:

Spheres made of silicon nitride ($Si_3N_4$) having starting dimensions of 6.12 mm were machined. A total of 340 items were machined in a test. The grinding time was 9 hours. The final diameter achieved was 5.956 mm. This corresponds to abrasion of up to 120 um over 9 hours. The achieved degree of surface roughness Ra is from 0.05 um to 0.06 um.

The tests reveal that a good abrasion rate is achieved even at a low groove depth. Normally in the grinding of spheres abrasion does not commence until groove depths of approximately 20% of the diameter of the sphere. At low groove depths, as in the present three tests, the geometry of the spheres is usually also relatively poor. However, the results of the three tests reveal that high abrasion, good roundness and outstanding divergence in diameter could be achieved even at a very low depth of the grooves in the grinding wheel. Compared to the high abrasion values, the degree of wear to the grinding wheel is very low. It is noteworthy that the elongate, barrel-shaped blanks in Test 2 can be machined just as well as round spherical blanks.

The good abrasion rate and the low degree of wear to the grinding wheel or the abrasive lining attached to the support plate using putty are due to the bonding of the abrasive grains in a synthetic resin. This bonding, in contrast to the electrolytic bonding in the prior art, ensures a slight or low resilient movement of the abrasive grains in the bonding matrix. This resilience allows the abrasive grains to deflect in the microscopic range in the event of peak toads such as can be caused by the extremely hard ceramic spheres, thus greatly increasing the service life of the grinding wheel. The abrasion rate is also improved because the spheres form grooves in the grinding wheel during the grinding process. The depth of the grooves is relatively low. It is, however, greater than in the case of electrolytically bound grinding wheels which are able to form almost no grooves.

Finally, it is to be expected in the case of electrolytically bound abrasive diamond grains on a metallic carrier plates that damage to the bonding will lead to breaking-out of entire regions of the bonding and thus to falling-out of the grinding wheel, and this is not the case in a grinding wheel bound in a synthetic resin, as a result of its self-sharpening mechanism.

As a result, the ground spheres were good in terms of roundness and the divergence in diameter. The abrasion rate is greater than the abrasion rates of known methods by at least one order of magnitude. The degree of surface roughness was examined merely in one case. Provision may be made in this regard for lapping to be provided after the coarse and fine grinding.

The novel method and the novel device for grinding ceramic spheres allow not only high abrasion rates with good grinding results but also the use of grinders accessible to modern streamlined or economical methods.

The use of hoppers for supplying the spheres is thus for example, possible. The use of cooling lubricants allows the grinding processes to be technologically controlled and corresponding fitter means to be connected, as a result of which the method can be made extremely environmentally friendly. The cleaning of the spheres after the grinding process is also particularly simple and can be carried out in conventional sphere washers as there is no adhering grinding paste as is typical for lapping.

The specification incorporates by reference the disclosure of German 10 2005 004 038.1 filed Jan. 27, 2005 and International application PCT/EP2006/000075 filed Jan. 6, 2006.

The present invention is, of course, in no way restricted to the specific disclosure of the specification and drawings, but also encompasses any modifications within the scope of the appended claims.

The invention claimed is:

1. A method of grinding spheres of ceramic material, including the steps of:

grinding the spheres with at least one grinding wheel (3*a*, 1*a*) containing abrasive grains bound in a synthetic resin bonding matrix, wherein the abrasive grains comprise more than 50% diamond and less than 5% $Cr_2O_3$, wherein said abrasive grains are bound in said bonding matrix in a manner that permits elastic movement of said abrasive grains in the bonding matrix.

2. A method according to claim 1, wherein the ceramic material is selected from the group consisting of oxide ceramics, carbides, silicon nitride, precious and semi-precious stones, and glass.

3. A method according to claim 1, wherein the abrasive grains comprise more than 90% diamond.

4. A method according to claim 3, wherein the abrasive grains are comprised of 100% diamond.

5. A method according to claim 1, wherein the synthetic resin bonding is a hot-pressed phenolic resin or polyimide bonding.

6. A method according to claim 1, wherein a steel or cast disc is provided as a guide disc (1).

7. A method according to claim 1, wherein said at least one grinding wheel (3*a*, 1*a*) has a grain size of from D181 to D2.

8. A method according to claim 1, wherein said at least one grinding wheel (3*a*) is secured to a support plate (3).

9. A method according to claim 1, wherein a cooling lubricant is supplied, and wherein said cooling lubricant is a honing oil or a grinding emulsion.

10. A method according to claim 1, wherein two grinding wheels (3*a*, 1*a*) are used in a stone-to-stone process.

11. A method according to claim 10, wherein said two grinding wheels (3*a*, 1*a*) are of substantially identical construction.

12. An apparatus for grinding spheres of ceramic material, comprising:

at least one grinding wheel (3*a*, 1*a*) containing abrasive diamond grains bound in a synthetic resin bonding matrix, wherein said abrasive grains are bound in said bonding matrix in a manner that permits elastic movement of said abrasive grains in the bonding matrix.

13. An apparatus according to claim 12, wherein the synthetic resin bonding is a hot-pressed phenolic resin bonding.

14. An apparatus according to claim 12, wherein a support plate (3) is provided, and wherein said at least one grinding wheel (3*a*) is secured to said support plate.

15. The use of a grinding wheel according to claim 12, including the step of grinding spheres of ceramic material, including oxide ceramics, carbides, silicon nitride, precious and semiprecious stones and/or glass, with said grinding wheel.

16. A method of grinding spheres of ceramic material, including the steps of:

providing at least one grinding wheel;

providing an abrasive liner on said at least on grinding wheel, wherein said abrasive liner contains abrasive grains bound in a synthetic resin bonding matrix, wherein the abrasive grains comprise more than 50% diamond and less than 5% $Cr_2O_3$, wherein said abrasive grains are bound in said bonding matrix in a manner that permits elastic movement of said abrasive grains in the bonding matrix; and grinding the spheres with the at least one grinding wheel (3*a*, 1*a*).

17. An apparatus for grinding spheres of ceramic material, comprising:

at least one grinding wheel (3*a*, 1*a*);

an abrasive liner attached to said at least one grinding wheel and containing abrasive diamond grains bound in a synthetic resin bonding matrix, wherein said abrasive grains are bound in said bonding matrix in a manner that permits elastic movement of said abrasive grains in the bonding matrix.

18. The apparatus as defined in claim 17, wherein the abrasive liner is attached to a support plate.

19. An apparatus for grinding spheres of ceramic material, comprising:

at least one first fixed grinding wheel;

at least one rotary second grinding wheel; ° a first abrasive liner secured to said at least one second rotary grinding wheel, wherein the abrasive liner contains abrasive diamond grains bound in a synthetic resin bonding matrix for grinding said spheres of ceramic material positioned between said at least one first fixed grinding wheel and said at least one second rotary grinding wheel, wherein said abrasive grains are bound in said bonding matrix in a manner that permits elastic movement of said abrasive grains in the bonding matrix.

20. The apparatus for grinding spheres as defined in claim 19, further comprising a second abrasive liner secured to said at least one first fixed grinding wheel.

21. A method for grinding spheres of ceramic material, comprising:

providing a first fixed guide disc having a plurality of guide grooves;

providing a second rotary guide disc having a plurality of guide grooves;

providing an abrasive liner to said first fixed guide disc, to second rotary guide disc, or to both said first fixed guide disc and said second rotary guide disc, said the abrasive liner containing abrasive diamond grains bound in a synthetic resin;

varying rotational speeds in regions of said guide grooves, thereby causing movement of said abrasive lining relative to a surface of said spheres.

* * * * *

UNITED STATES PATENT AND TRADEMARK OFFICE

CERTIFICATE OF CORRECTION

PATENT NO. : 7,722,440 B2
APPLICATION NO. : 11/814975
DATED : May 25, 2010
INVENTOR(S) : Pötzsch et al.

It is certified that error appears in the above-identified patent and that said Letters Patent is hereby corrected as shown below:

Title Page, Item (57) Abstract: Line 2, after "including" insert --grinding--.

Signed and Sealed this

Thirteenth Day of July, 2010

David J. Kappos

David J. Kappos
*Director of the United States Patent and Trademark Office*